US008028420B2

(12) United States Patent
Gui et al.

(10) Patent No.: US 8,028,420 B2
(45) Date of Patent: Oct. 4, 2011

(54) SLIDING CUTTING TOOL

(75) Inventors: Yao Kun Gui, Shanghai (CN); Zheng Guo Wang, Shanghai (CN)

(73) Assignee: Meridian International Co., Ltd. (CN)

( * ) Notice: Subject to any disclaimer, the term of this patent is extended or adjusted under 35 U.S.C. 154(b) by 198 days.

(21) Appl. No.: 12/367,890

(22) Filed: Feb. 9, 2009

(65) Prior Publication Data

US 2010/0154224 A1 Jun. 24, 2010

(30) Foreign Application Priority Data

Dec. 22, 2008 (CN) ..... 2008 2 0157545 U

(51) Int. Cl.
*B26B 1/08* (2006.01)

(52) U.S. Cl. ..... 30/162; 30/335

(58) Field of Classification Search ..... 30/2, 162, 30/335

See application file for complete search history.

(56) References Cited

U.S. PATENT DOCUMENTS

| | | | | |
|---|---|---|---|---|
| 3,577,637 | A * | 5/1971 | Braginetz | 30/162 |
| 4,835,865 | A * | 6/1989 | Knoop | 30/162 |
| 5,406,707 | A * | 4/1995 | Owens et al. | 30/162 |
| 5,571,127 | A * | 11/1996 | DeCampli | 606/167 |
| 6,314,646 | B1 * | 11/2001 | Schmidt | 30/162 |
| 6,357,120 | B1 | 3/2002 | Khachatoorian et al. | |
| 6,742,261 | B2 | 6/2004 | Ho et al. | |
| 6,907,668 | B2 * | 6/2005 | Polei | 30/162 |
| 7,448,136 | B2 | 11/2008 | Huang et al. | |
| 7,540,092 | B2 * | 6/2009 | Polei | 30/162 |
| 7,797,836 | B2 * | 9/2010 | Ranieri et al. | 30/162 |
| 7,797,837 | B2 * | 9/2010 | Wu | 30/162 |
| 2009/0223063 | A1 * | 9/2009 | Hallquist et al. | 30/162 |
| 2009/0241345 | A1 * | 10/2009 | Huang | 30/123 |
| 2009/0277016 | A1 * | 11/2009 | Wu | 30/162 |

* cited by examiner

*Primary Examiner* — Hwei C Payer
(74) *Attorney, Agent, or Firm* — Jason R. Sytsma; Shuttleworth & Ingersoll, PLC

(57) ABSTRACT

A novel utility knife in which the parts for securing and replacing the cutting blade are selectively movable in and out of the handle of the knife via a single track system. The blade is secured through a series of elastic metal sheets, one of which contains a projection on a metal tab. The lateral manipulation of the metal tab allows the blade to disengage from the metal sheets. Once disengaged, a user of the utility knife may remove or replace the cutting blade.

2 Claims, 5 Drawing Sheets

SLIDING CUTTING TOOL

CROSS-REFERENCE TO RELATED APPLICATIONS

The present application claims priority under 35 USC 119 to Chinese Patent Application No. 200820157545.3 filed on Dec. 22, 2008, the entire contents of which application is hereby incorporated by reference.

TECHNICAL FIELD

The invention relates to a handheld cutting tool utilized in the construction industry and in households generally known as a utility knife.

BACKGROUND INFORMATION

At present, a cutting tool widely used in both the industry and the household construction is a handheld instrument with a blade commonly referred to as a utility knife. A utility knife generally has an elongated fixed handle, which is equipped with a sliding mechanism which can control the expansion of a cutting blade. The blade used by a utility knife is generally movable in and out of the elongated handle. Additionally, the handle typically houses the means for securing the blade. The rigidity of the elongated handle coupled with the placement of the securing mechanism within the handle has made the replacement of the cutting blade difficult.

In addition to the difficulty of blade replacement, the sliding mechanism of a utility knife generally includes a double guided rail and a column pulley system. This type of system has the shortcoming of producing a sliding of the fixed blade which lacks smoothness. Furthermore, the sliding mechanism and the means for securing the cutting blade cannot be extended from the elongated handle creating the need for a longer utility knife. A longer utility knife makes the tool less convenient to be used and carried.

SUMMARY

The present invention is intended to overcome the shortcomings existing in the current system used to secure the cutting blade of a standard utility knife. Specifically, the invention solves the difficulty in replacing the cutting blade of a utility knife by providing a mechanism for exterior blade replacement. The mechanism allows a user to replace the blade without the need for disassembling the handle of the utility knife. In addition, the invention allows the blade, the components securing the blade and the components allowing the replacement of the blade to be stored within the handle via a track system.

The improved utility knife contains a series of flexible metal sheets securing a removable cutting blade. The metal sheets cooperate to form a groove in which an elastic tab is located. The elastic tab further contains a projection that interacts with U-shaped grooves in the cutting blade. The interaction between the projection and the U-shaped grooves secures the cutting blade to the metal sheets. Lateral manipulation of the elastic tab disengages the projection from the U-shaped grooves allowing the cutting blade to be easily removed and replaced. A second securing structure located on the metal sheets contacts the cutting blade and pushes up against the cutting blade. This contact provides the necessary force to keep the cutting blade from falling out of the metal sheets due to the force of gravity alone. A person using the invention can overcome the force generated by the second securing structure by pulling on the cutting blade while the elastic tab is disengaged.

The cutting blade as well as the metal sheets securing the blade can be selectively housed in the handle of the utility knife through a sliding rail system. The system contains two fixed positions corresponding to either a fully retracted position or a fully extended position. Two sliding guide blocks are attached to the metal sheets and allow the metal sheets and cutting blade to be moved in the sliding rail system from the fully extended position to the fully retracted position. While in either position a flange on a selectively depressible button is engaged with a notch preventing movement of the two sliding blocks. The depression of the button disengages the flange from the notch and allows the user to slide the button and sliding blocks to the opposite fixed position or any position in between the two fixed positions. The cutting blade and the replacement mechanism are exposed when the utility knife is in the fully extended position. When in the fully retracted position, the cutting blade and the metal sheets are housed entirely within the handle of the utility knife.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
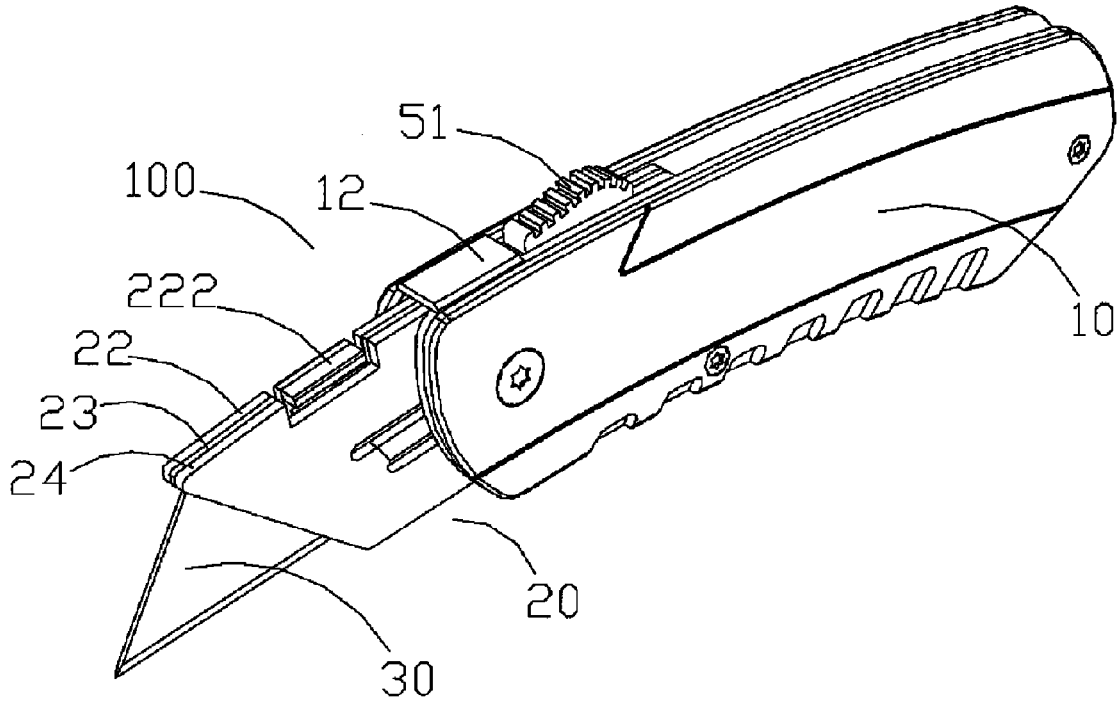
FIG. 1 is a perspective view of the invention.

Now referring to the drawings, FIG. 1 shows a novel utility knife 100. The utility knife 100 comprises an exterior shell 10, a metal block 20 and a cutting blade 30. The cutting blade 30 is selectively attachable within the metal block 20. The metal block 20 further comprises a first member 22, a second member 23 and a third member 24. The first member 24 contains a tab 222. Two slide guiding blocks are affixed on the metal block 20, and are selectively slideable within a single sliding track 111 as seen in FIG. 3.

Figure 5:
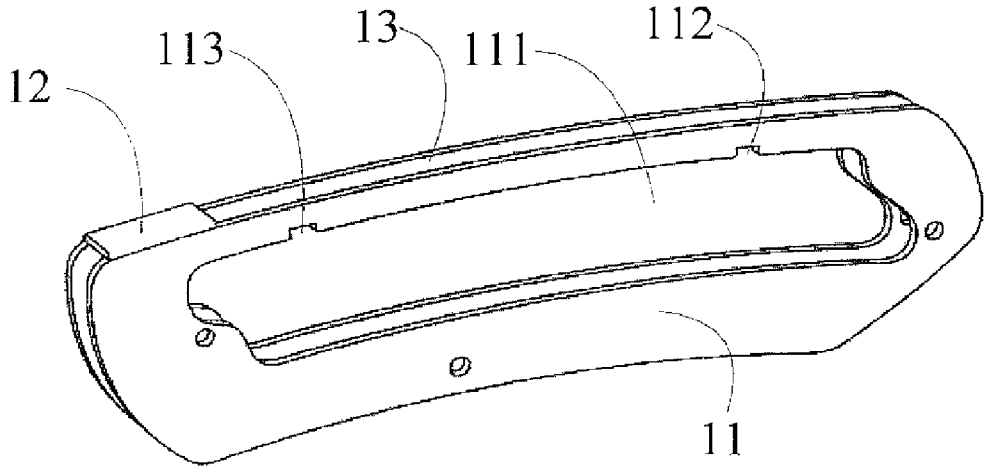
FIG. 5 is a perspective view of the blade housing.
Figure 6:
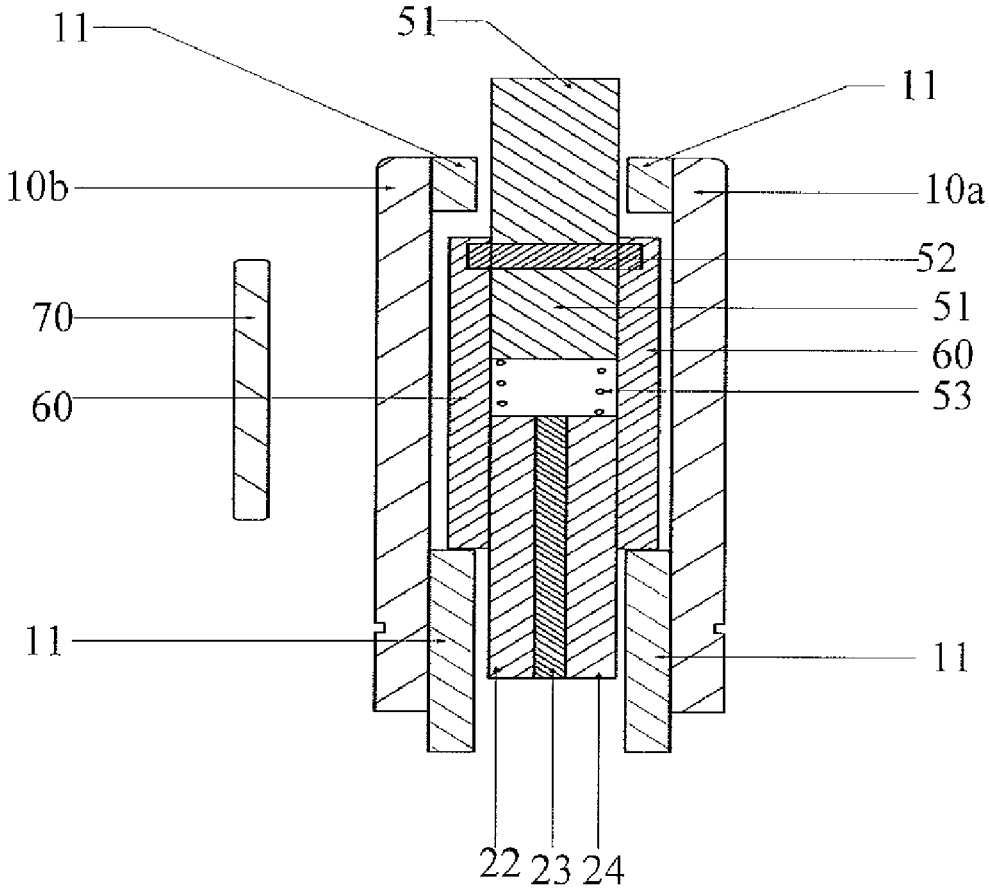
FIG. 6 is a cross-sectional view of the invention taken at line A-A of FIG. 2.

The exterior shell 10 may comprise a first cover plate 10*a*, a second cover plate 10*b* and track rails 11 shown in FIG. 6. As is shown in FIG. 5, the track rails 11, form a hollow, rigid structure in which the track rails 11 are preferably fixed to the first cover plate 10*a* and the second cover plate 10*b*. A track rail bridge 12 connects the two track rails 11, preferably at the upper front portion of the track rails 11 keeping them substantially parallel to one another. The other portions of the track rails 11 remain substantially unattached forming a slideway 13. A single sliding track 111 is formed from the arrangement of the two track rails 11. The upper portion of the single sliding track 111 comprises a back groove 112 and a front groove 113.

Figure 3:
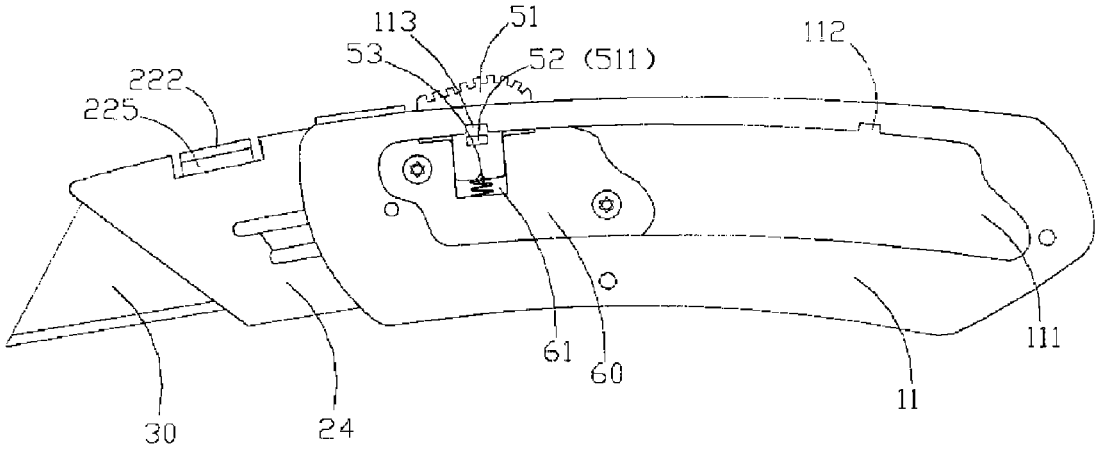
FIG. 3 is a left side view of the invention where the cover plate has been removed and the cutting blade is in a fully extended position.
Figure 9:
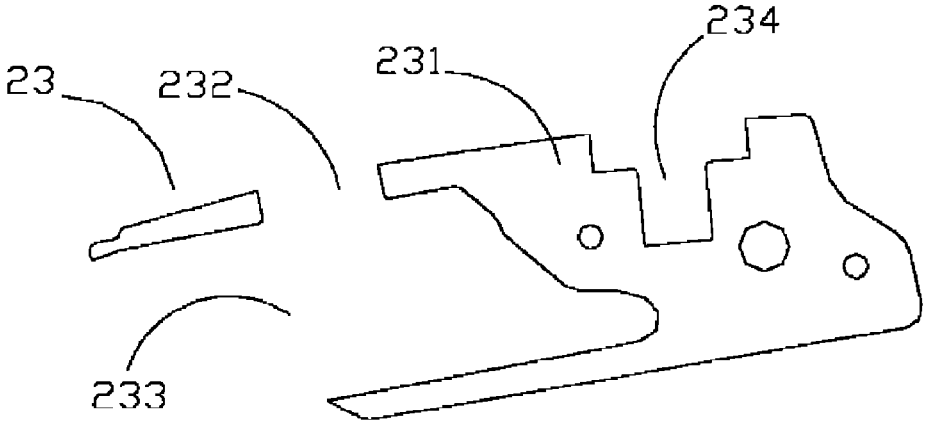
FIG. 9 is a structural diagram of the second member shown in FIG. 1.
Figure 10:
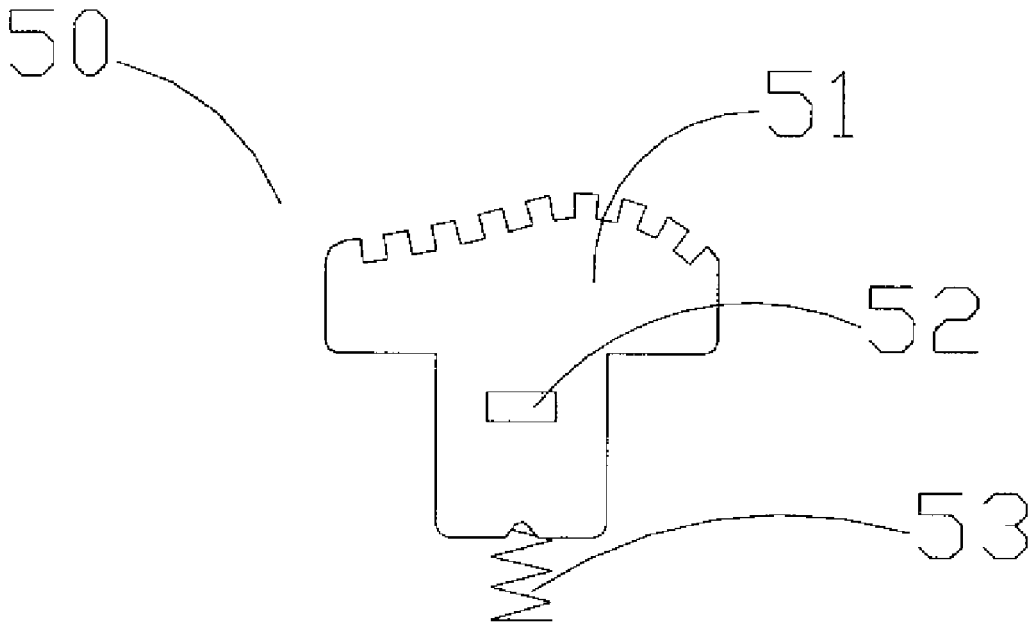
FIG. 10 is a structural diagram of the sliding member shown in FIG. 1.

As seen in FIGS. 3, 6 and 10 sliding guide blocks 60 are selectively movable within the sliding track 111 through cooperation with the sliding member 50. The two sliding guide blocks 60 are affixed to the metal block 20, and a guide block void 61 is in cooperation with a button cavity 224, 234 and 244 (seen in FIGS. 7-9) of metal block 20. The sliding member 50 comprises a button 51, a flange 52 and a spring element 53; wherein, the button 51 is equipped with the flange 52 preferably protruding from each side of the button 51.

The metal block 20 is preferably made of elastic steel consisting of one continuous piece. As is shown in FIG. 1 and FIG. 6, the metal block comprises a first member 24, a second member 23 and a third member 22 with the second member 23 located between the first member 24 and third member 22. The two sliding guide blocks 60 are affixed to the first member 24 and the third member 22 preferably by a metal fastener.

Figure 7:
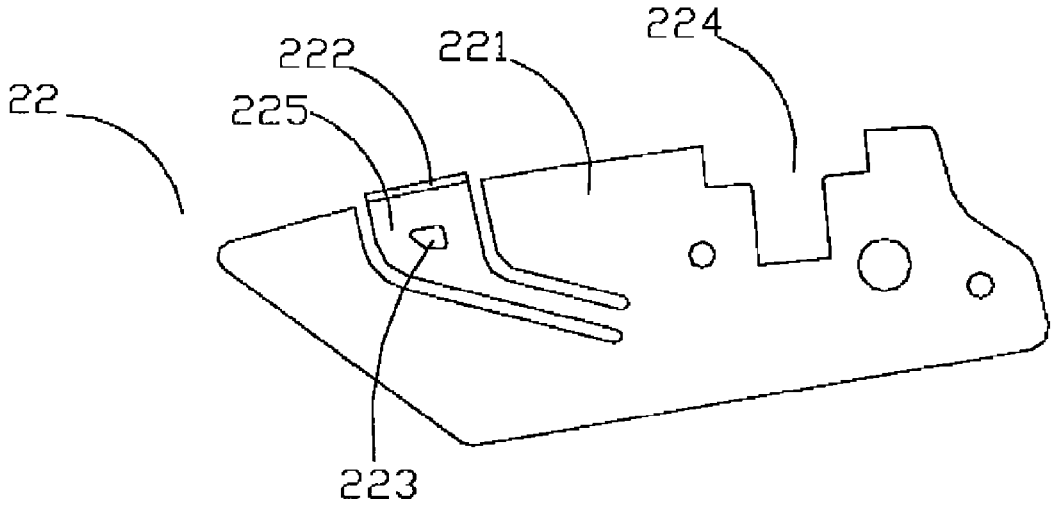
FIG. 7 is a structural diagram of the third member shown in FIG. 1.
Figure 8:
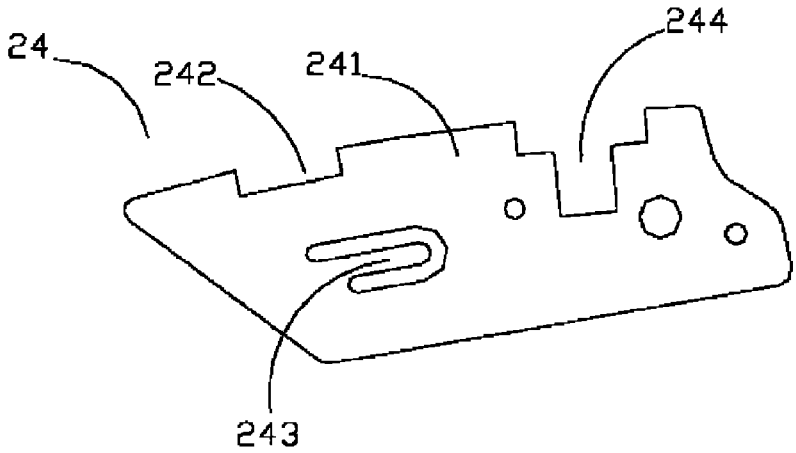
FIG. 8 is a structural diagram of the first member shown in FIG. 1.

As is shown in FIG. 7, FIG. 8 and FIG. 9, the first member 24, the second member 23 and the third member 22 respectively comprise a first member body 241, a second member body 231 and a third member body 221. In addition, the bodies contain respectively a first void 244, a second void 234 and a third void 224. The voids 244, 234 and 224 along with the guide block void 61 form a cavity for the sliding member 50 as seen in FIG. 3. As is shown in FIG. 3, FIG. 4 and FIG. 6, the button 51 and a portion of the metal block 20 are transversed by the spring member 53.

Again referring to FIG. 1 and FIG. 3, the metal block 20 and the sliding guide blocks 60 are then arranged in the track rails 11 and the sliding guide blocks 60 are slideable within the single sliding track 111. Because the invention uses the single sliding track 111 to cooperate with the sliding guide blocks 60 a large contact area is created which enhances the smoothness and the stability of the sliding mechanism.

Figure 4:
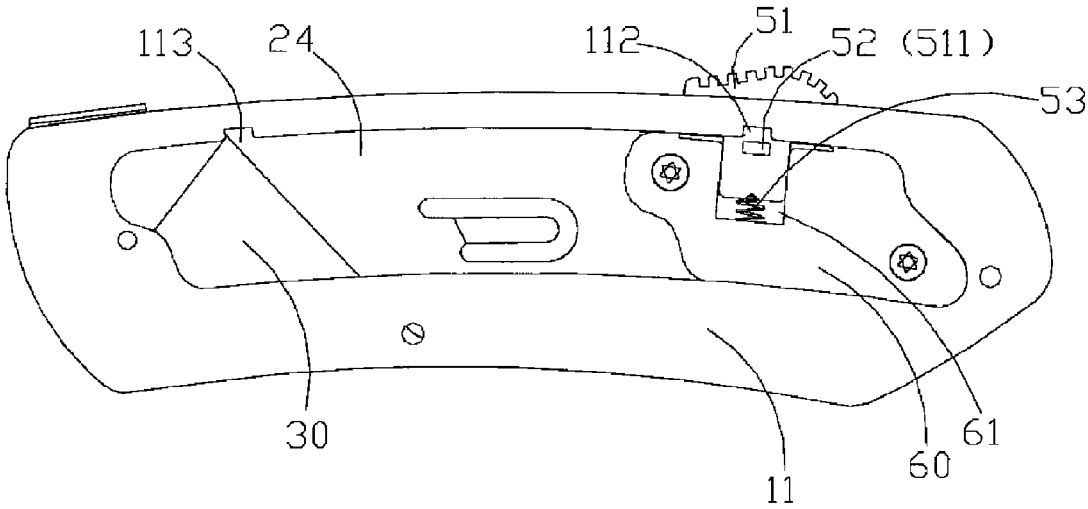
FIG. 4 is a left side view of the invention where the cover plate has been removed and the cutting blade is in a retracted position.

Now referring to FIG. 3 and FIG. 4, the flange 52 extends from the external part of the button 51 and is selectively engagable with the front groove 113 or the rear groove 112 creating a snap-in connection and one of the two fixed positions. When the button 51 of the sliding member 50 is pressed, the spring member 53 is compressed causing the flange 52 to disengage from the front groove 113 or the rear groove 112, allowing the user to slide the sliding member 50 on the slideway 13. The sliding action also causes the sliding guide blocks 60 to slide in the single sliding track 111. As is shown in FIG. 3, when the flange 52 is locked in the front groove 113, the metal block 20 along with the cutting blade 30 is fixed at the fully extended position as is shown in FIG. 4, when the flange 52 is locked in the rear groove 112, the metal block 20 along with the cutting blade 30 is fixed at the fully retracted position.

The third member 22, shown in FIG. 1 and FIG. 7, further comprises a flexible metal strip 225 formed by offset channels. The lower portion of the flexible metal strip 225 is connected to the third member body 221, while the remaining portions of the metal strip 225 remain unattached from the third member body 221. A projection 223 is stamped on the metal strip 225 such that it projects toward the first member 24 and second member 23. A pushing tab 222 on the upper portion of the metal strip 225 also extends toward the first member 24 and second member 23. As is shown in FIG. 8 and FIG. 9, pushing tab gaps 242 and 232 are respectively arranged on the first member 24 and the second member 23 such that they correspond to the pushing tab 222. Now referring additionally to FIG. 1, the pushing tab 222 is contained in the pushing block gaps 232 and 242 once the first member 24, the second member 23 and the third member 22 are assembled together.

Figure 11:
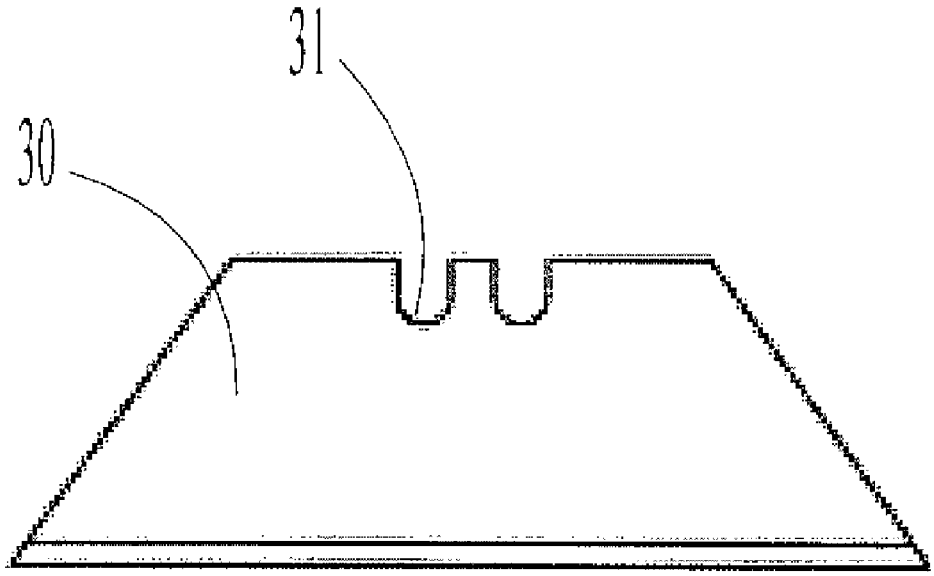
FIG. 11 is a structural diagram of the cutting blade shown in FIG. 1.

As is shown in FIG. 9, a blade mounting slot 233 at the front end of the second member body 231 of the second member 23 is in communication with the push block gaps 232, 242. Now referring additionally to FIG. 11, the cutting blade 30 is arranged in the blade mounting slot 233. U-shaped blade grooves 31 on the cutting blade 30 cooperate with the projection 223 of the metal strip 225 thereby securing the cutting blade 30 to the metal block 20 when the cutting blade 30 is placed in the blade mounting slot 223.

For the front metal sheet 24 shown in FIG. 8, a pressure strip 243 is formed on the first member body 241 by a U-shaped cutout. The front end of the pressure strip 243 is bent slightly toward the inner surface of the first member 24 causing it to make slight contact with the cutting blade 30 when the cutting blade 30 is inserted in the blade mounting slot 233. This contact provides enough force to prevent the cutting blade 30 from disengaging from the metal block 20 due solely to the force of gravity. The force exerted by the pressure strip 243 can be overcome by the user pulling on the cutting blade 30 while the projection 223 is disengaged from the grooves 31 of the cutting blade 30.

Due to the elasticity of the first member 24 and the third member 22, when the pushing tab 222 is pushed toward the exterior of the third member 22, the entire metal strip 225 including the projection 223 can be driven by the lateral movement of the pushing tab 222. The projection 223 on the metal strip 225 is thereby caused to disengage from the grooves 31 of the cutting blade 30, thus, allowing the cutting blade 30 to be either removed or replaced.

Figure 2:
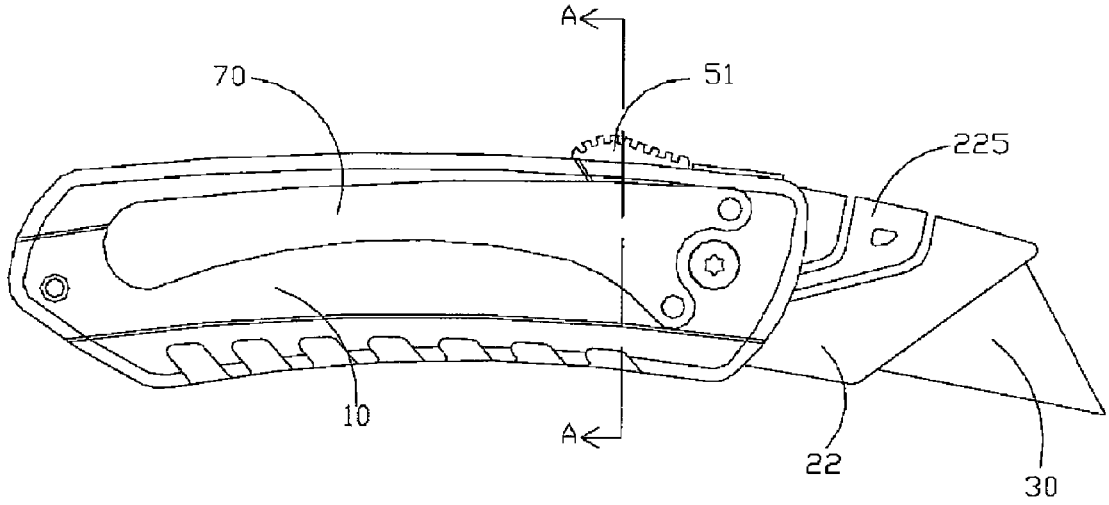
FIG. 2 is a right side view of the novel invention.

In addition, as is shown in FIG. 2 and FIG. 6, a clip 70 can also be fixed on the exterior shell 10 by a fastening device which allows users the convenience of carrying the utility knife 100 on a belt or other item.

Having thus described the invention in connection with the preferred embodiments thereof, it will be evident to those skilled in the art that various revisions can be made to the preferred embodiments described herein without departing from the spirit and scope of the invention. It is my intention, however, that all such revisions and modifications that are evident to those skilled in the art will be included within the scope of the following claims.

We claim:

1. A handheld utility knife comprising:

a removable cutting blade, a metal block comprising a flexible tab, the removable cutting blade selectively engageable by the flexible tab, at least one sliding guide block, a sliding track, the at least one sliding guide block selectively slidable within the sliding track, the at least one sliding guide block connected to the metal block, the flexible tab comprising a projection, the removable cutting blade containing at least one groove, the projection securing the removable cutting blade through engaging the at least one groove, the metal block comprising a first member, a second member and a third member, the flexible tab being on the third member, the second member contains a void, the removable cutting blade selectively insertable within the void, the first member comprising a pressure strip, the pressure strip selectively engageable with the removable cutting blade, the first member, the second member and the third member containing a void, the at least one sliding guide block containing a recess, the voids and the recess communicating with one another to form a space for a sliding member, the sliding member comprising a flange, the sliding track comprising at least one groove, the flange selectively fixable in the at least one groove, the sliding member movable over the sliding track.

2. The utility knife of claim 1 wherein:

the sliding member further comprises a top and a bottom, a spring member is in communication with the bottom and the at least one sliding guide block, the spring member forces the flange into the at least one groove.

* * * * *